US009353922B2

(12) United States Patent
Ferrier

(10) Patent No.: US 9,353,922 B2
(45) Date of Patent: May 31, 2016

(54) WALL WASH LIGHT FIXTURE AND METHOD FOR LIGHTING A WALL

(71) Applicant: Pinnacle Architectural Lighting, Denver, CO (US)

(72) Inventor: David James Ferrier, Denver, CO (US)

(73) Assignee: Pinnacle Architectural Lighting, Denver, CO (US)

( * ) Notice: Subject to any disclaimer, the term of this patent is extended or adjusted under 35 U.S.C. 154(b) by 121 days.

(21) Appl. No.: 14/175,810

(22) Filed: Feb. 7, 2014

(65) Prior Publication Data

US 2015/0226401 A1 Aug. 13, 2015

(51) Int. Cl.

| | |
|---|---|
| ***F21S 8/02*** | (2006.01) |
| ***F21V 7/00*** | (2006.01) |
| *F21Y 101/02* | (2006.01) |

(52) U.S. Cl.

CPC ..... *F21S 8/026* (2013.01); *F21V 7/0008* (2013.01); *F21V 7/0025* (2013.01); *F21Y 2101/02* (2013.01)

(58) Field of Classification Search

CPC ..... F21S 8/026; F21V 7/09; F21V 7/0008; F21V 7/0025

See application file for complete search history.

(56) References Cited

U.S. PATENT DOCUMENTS

| | | | | |
|---|---|---|---|---|
| 4,748,543 | A * | 5/1988 | Swarens | F21S 8/02 362/147 |
| 5,032,958 | A * | 7/1991 | Harwood | F21V 7/005 362/217.06 |
| 5,142,459 | A * | 8/1992 | Swarens | F21V 7/0008 362/147 |
| 6,942,364 | B1 * | 9/2005 | Wegner | F21S 8/026 362/147 |
| 2014/0003040 | A1 * | 1/2014 | Holman | F21K 9/52 362/147 |
| 2015/0241027 | A1 * | 8/2015 | Zhang | F21V 13/02 362/300 |

* cited by examiner

*Primary Examiner* — Mary Ellen Bowman

(57) ABSTRACT

A light fixture has a housing with a bottom plate at least partially defining an opening. A light source is disposed within the housing. A reflector is disposed such that light emitted from the light source is received by the reflector and reflected. The reflector has a direct reflection surface disposed within the housing for receiving light emitted from the light source and reflecting (a) a first portion of light directly out of the opening and (b) a second portion of light. An indirect reflection surface for receiving the second portion of light from the direct reflection surface and reflecting the second portion of light, wherein the at least a portion of the indirect reflection surface is disposed on an exterior of the bottom plate.

20 Claims, 16 Drawing Sheets

WALL WASH LIGHT FIXTURE AND METHOD FOR LIGHTING A WALL

INTRODUCTION

Wall wash light fixtures are used in internal spaces, such as retail and commercial establishments, to illuminate a wall along all or nearly all of its entire height. Such lighting draws attention to the wall for aesthetic or other purposes. Typically, these wall wash fixtures are installed recessed within a ceiling, proximate the wall. Distributing the light evenly along the height of the wall presents a challenge, since portions of the wall closest to the ceiling are typically lit by significantly more light than portions of the wall proximate the floor. Additionally, interior designers, architects, and building owners often desire that the wall wash fixture itself be unobtrusive within the space.

SUMMARY

This summary is provided to introduce a selection of concepts in a simplified form that are further described below in the Detailed Description. This summary is not intended to identify key features or essential features of the claimed subject matter, is not intended to describe each disclosed embodiment or every implementation of the claimed subject matter, and is not intended to be used as an aid in determining the scope of the claimed subject matter. Many other advantages, features, and relationships will become apparent as this description proceeds. The figures and the description that follow more particularly exemplify illustrative embodiments.

In one aspect, the technology relates to a light fixture which includes a housing having a bottom plate at least partially defining an opening; a light source disposed within the housing; and a reflector disposed such that light emitted from the light source is received by the reflector and reflected, wherein the reflector includes: a direct reflection surface disposed within the housing for receiving light emitted from the light source and reflecting (a) a first portion of light directly out of the opening and (b) a second portion of light; and an indirect reflection surface for receiving the second portion of light from the direct reflection surface and reflecting the second portion of light, wherein the at least a portion of the indirect reflection surface is disposed on an exterior of the bottom plate. In an embodiment, the direct reflection surface includes four direct reflection zones, wherein a first direct reflection zone and a second direct reflection zone reflect the first portion of light. In another embodiment, a third direct reflection zone and a fourth direct reflection zone reflect the second portion of light. In yet another embodiment, the indirect reflection surface includes: a first indirect reflection zone for receiving light from the third direct reflection zone; and a second indirect reflection zone for receiving light from the fourth direct reflection zone. In still another embodiment, the third direct reflection zone at least partially overlaps the first direct reflection zone and the second direct reflection zone.

In another embodiment of the above aspect, the first indirect reflection zone at least partially overlaps the second indirect reflection zone. In an embodiment, the direct reflection surface has a plurality of surfaces. In another embodiment, the first direct reflection zone and the fourth direct reflection zone are associated with a high relative specularity surface, and the second direct reflection zone is associated with a low relative specularity surface. In yet another embodiment, all of the second indirect reflection zone is disposed on the portion of the indirect reflection surface disposed on the exterior of the bottom plate. In still another embodiment, the light fixture further has at least one of a translucent lens and a baffle proximate the opening.

In another aspect, the technology relates to a method of lighting, with a light fixture disposed in a ceiling, a wall having a first wall portion located proximate a bottom edge of the wall, a second wall portion disposed above the first wall portion, a third wall portion disposed above the second wall portion, and a fourth wall portion disposed above the third wall portion and proximate the ceiling, the method including: emitting light from a light source disposed within the light fixture, wherein the light is emitted in a direction away from the wall; receiving the emitted light at a direct reflection surface; reflecting at least a first portion of the emitted light from the direct reflection surface to the first wall portion and the second wall portion; reflecting at least a second portion of the emitted light from the direct reflection surface to an indirect reflection surface; receiving the second portion of emitted light at the indirect reflection surface; and reflecting the second portion of emitted light from the indirect reflection surface to the third wall portion and the fourth wall portion. In an embodiment, the direct reflection surface has a first direct reflection zone for reflecting the light to the first wall zone and a second direct reflection zone for reflecting the light to the second wall zone. In another embodiment, the first direct reflection zone has a specularity greater than a specularity of the second direct reflection zone.

In yet another aspect, the technology relates to a light fixture having: a housing defining an interior; a bottom plate secured to the housing, the bottom plate at least partially defining an opening; a light source disposed within the interior; a direct reflection surface disposed in the interior opposite the light source, wherein the direct reflection surface is adapted to reflect light emitted by the light source; an indirect reflection surface disposed opposite the bottom plate from the interior and proximate the opening, wherein the indirect reflection surface is adapted to reflect at least a portion of the light reflected by the direct reflection surface. In an embodiment, the direct reflection surface has a high relative specularity surface and a low relative specularity surface. In another embodiment, the indirect reflection surface has a low relative specularity surface. In yet another embodiment, the direct reflection surface is substantially concave and wherein the indirect reflection surface is substantially convex. In still another embodiment, the high relative specularity surface has a perforated element.

In another embodiment of the above aspect, the light fixture further includes at least one of a translucent lens and a baffle proximate the opening. In an embodiment, at least a portion of the indirect reflection surface is disposed both in the interior and on an exterior of the housing.

BRIEF DESCRIPTION OF THE DRAWINGS

There are shown in the drawings, embodiments which are presently preferred, it being understood, however, that the technology is not limited to the precise arrangements and instrumentalities shown.

DETAILED DESCRIPTION

Figure 1A:
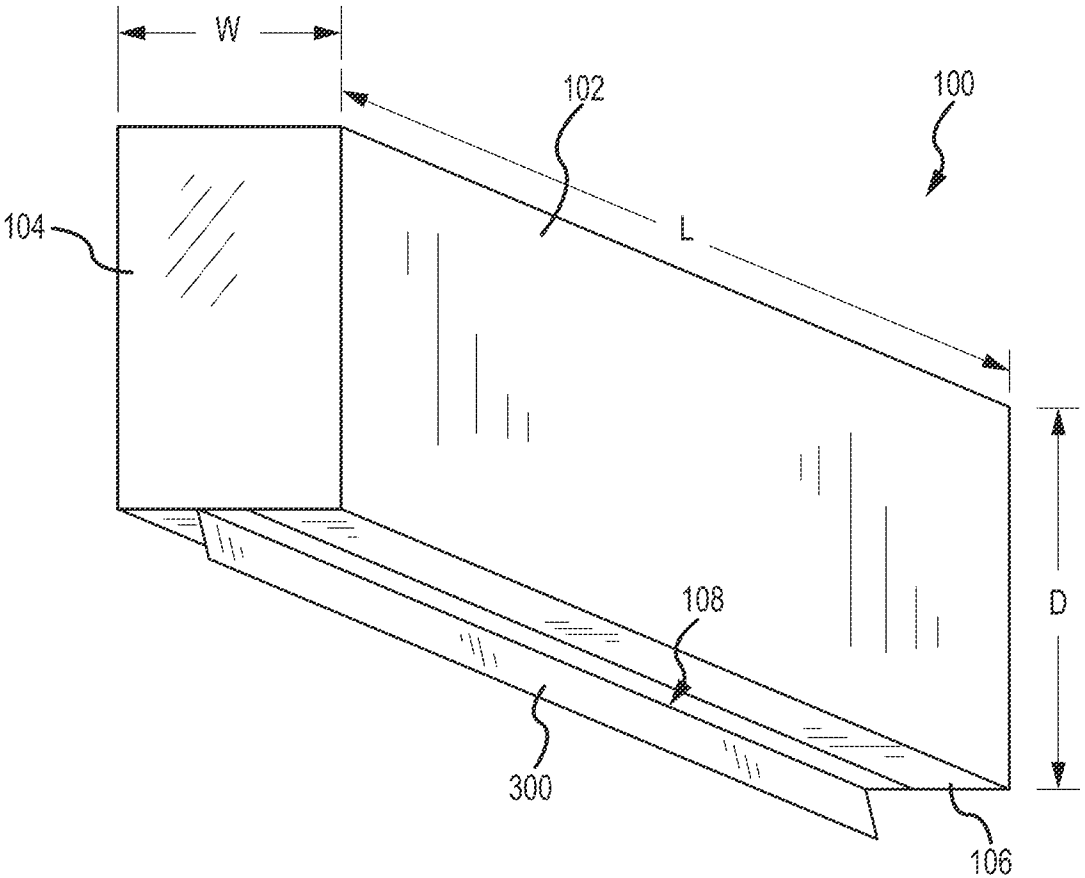
FIG. 1A depicts a perspective view of a wall wash light fixture in accordance with one embodiment of the technology.

FIG. 1A depicts a perspective view of a wall wash light fixture in accordance with an embodiment of the technology. The light fixture 100 includes a housing 102 having a length L, a depth D, and a width W. The light fixture housing 102 may be manufactured in any dimensions required or desired for a particular application. It may be desirable, however, to minimize the depth D and width W. A smaller housing depth D reduces potential interference between the light fixture 100 and features contained within a ceiling space, such as cabling, building structural elements, plumbing or HVAC components, etc. A smaller housing width W reduces the overall appearance of the light fixture once installed, making the light fixture 100 less obtrusive on the ceiling. The length L may be any desired length for a particular application, although lengths of about two feet, about three feet, about four feet, about six feet, and about eight feet are contemplated. Multiple light fixtures 100 may be abutted along their lengths so as to produce a combined light fixture having a significant length (to illuminate, e.g., a very long wall). The light fixture 100 may or may not include one or more end plates 104. A bottom plate 106 is secured proximate a bottom portion of the housing 102, and at least partially defines an opening 108 out of which light is emitted from one or more light sources disposed in the interior of the housing 102. A portion of a reflector 300 extends below the bottom plate 106, proximate the opening 108. In certain embodiments, the reflector 300 may partially define the opening 108. The light fixture 100 may be installed in both acoustic and inaccessible ceilings and may include other components for aesthetic or other purposes. The opening 108 may be consistent along the entire length L of the fixture 100, or may terminate a distance from the end plates 104. In other embodiments, the opening 108 may be a plurality of openings, although such a configuration may be less aesthetically pleasing and may project a less desirable light pattern.

Figure 1B:
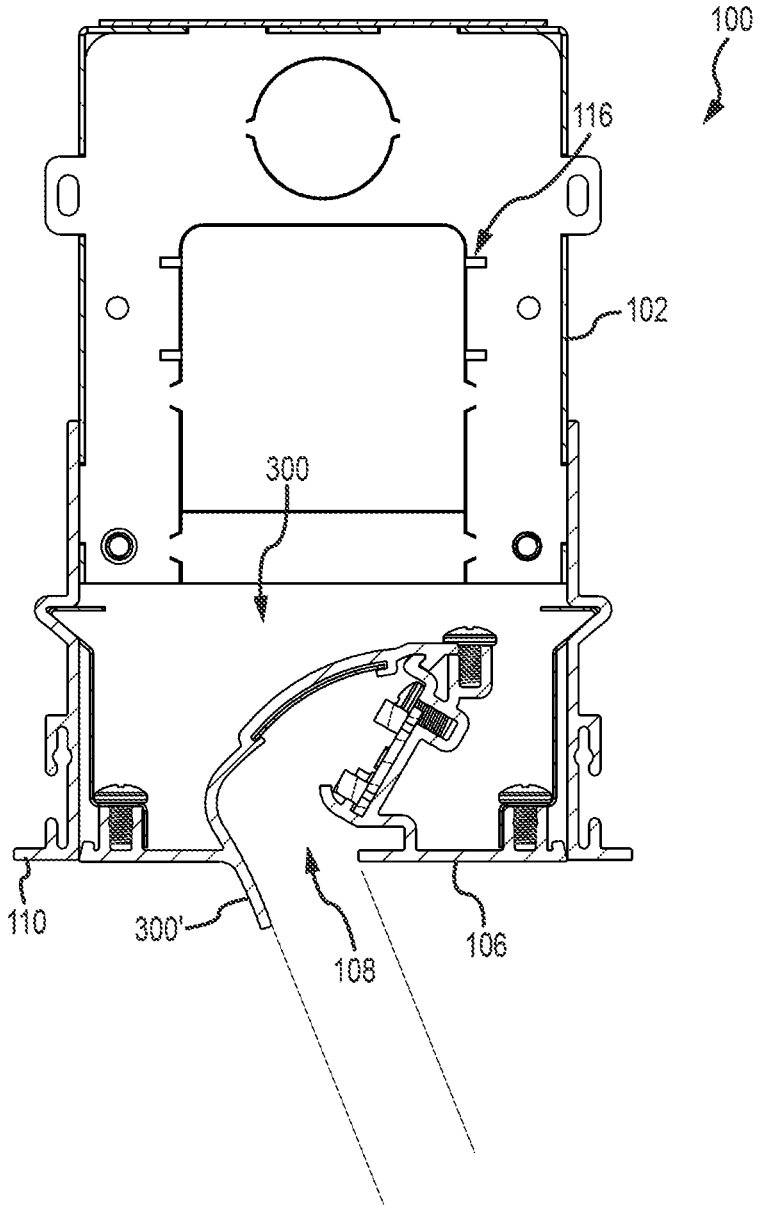
FIG. 1B depicts a side sectional view of a wall wash light fixture in accordance with another embodiment of the technology.
Figure 2:
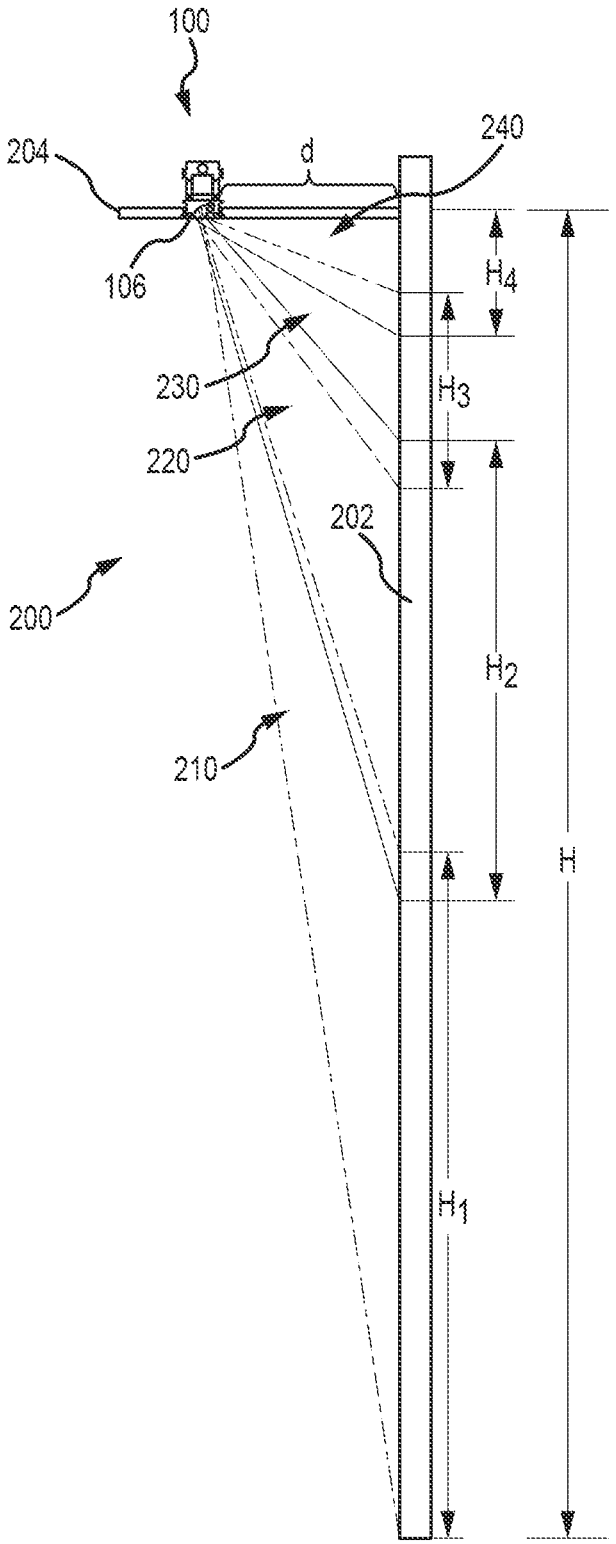
FIG. 2 depicts a beam pattern for lighting a wall with a wall wash light fixture in accordance with an embodiment of the technology.

FIG. 1B depicts a side sectional view of a wall wash light fixture 100. Like the embodiment of FIG. 1B, this embodiment includes a housing 102 and bottom plate 106. Here, both the bottom plate 106 and a lip 300' of a reflector 300 define the opening 108. The configuration of the reflector 300 is described in more detail below. An escutcheon plate 110 surrounds the bottom plate 106 for aesthetic purposes. An interior 116 of the housing 102 includes drivers and wiring and may be actively or passively ventilated to manage heat. FIG. 2 depicts a beam pattern 200 for lighting a wall 202 with a wall wash light fixture 100 in accordance with an embodiment of the technology. The light fixture 100 is installed above a ceiling 204, with the bottom plate 106 of the fixture 100 substantially coplanar with the ceiling 204. The wall 202 has a height H and the light fixture 100 is installed a distance d from the wall 202. In certain embodiments, the wall height may be about 12 feet and the distance d may be about 12 inches to about 18 inches to light such a wall. Other heights H and distances d are contemplated. For example, embodiments of the light fixture depicted herein may be used to illuminate walls having heights of about 10 feet, about 14 feet, and about 18 feet or more, although taller walls may not be adequately illuminated proximate the bottom of the wall. For certain applications, this may be acceptable. The depicted beam pattern 200 includes at least four discrete beam portions, which are defined by the heights or portions of the wall 202 that those beam portions illuminate. A first beam portion 210 illuminates a first height $H_1$ proximate a bottom of the wall 202. Moving up the wall 202, a second beam portion 220 illuminates a second height $H_2$. A third beam portion 230 illuminates a third height $H_3$ of the wall 202. Proximate the ceiling 204, a fourth beam portion 240 illuminates a fourth height $H_4$. The portions of the light fixture 100 that illuminate the various wall heights or portions are described in more detail below.

Figure 3:
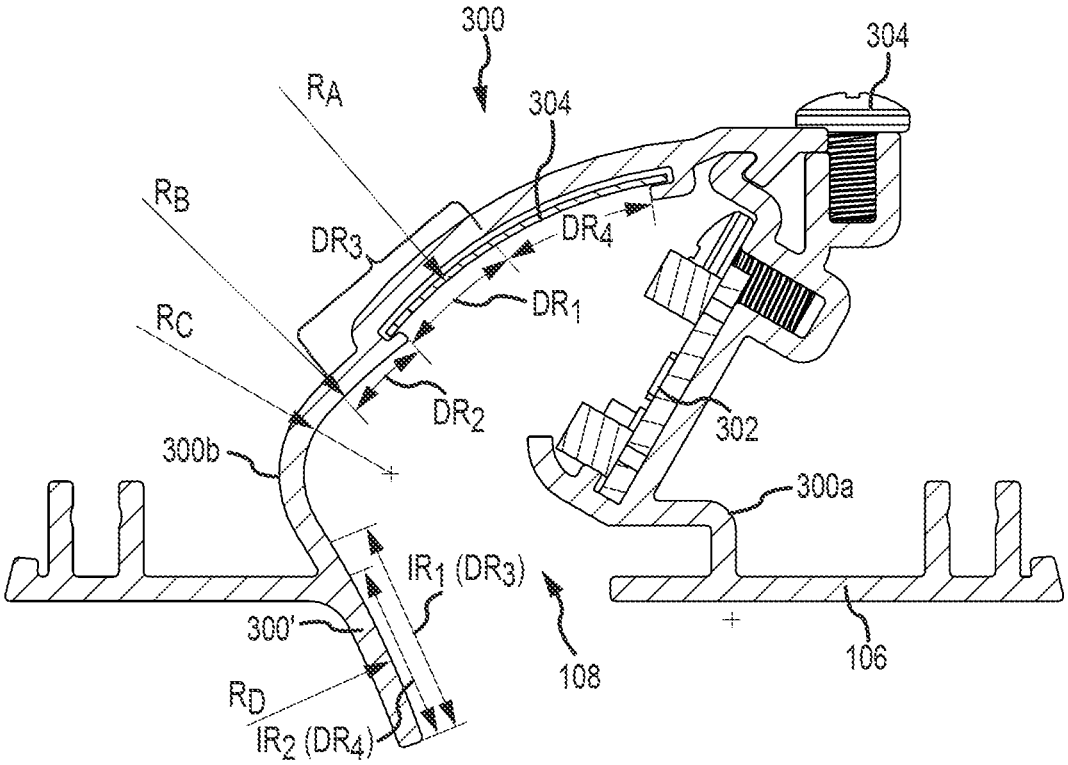
FIG. 3 depicts a side sectional view of a reflector profile for a wall wash fixture in accordance with an embodiment of the technology.

FIG. 3 depicts a side sectional view of a reflector 300 profile for a wall wash light fixture. A light source 302, is incorporated into the reflector 300. In certain embodiments, the light source 300 may be an LED diode, such as product number 757V1 manufactured by Nichia Corporation. Other LED diodes include ⅛ inch×⅛ inch LED diodes, or diodes of other sizes. In other embodiments, the light source 302 may be fluorescent or incandescent. In the depicted embodiment, a plurality of light sources 300 extend evenly spaced along the length of the reflector 300 so as to provide an even, dispersed beam pattern. The light source 300 is directed away from the wall. In the depicted embodiment, the reflector 300 is extruded integral with the bottom plate of the light fixture. At least two portions 300*a*, 300*b* are depicted and may be assembled with screws, bolts, adhesives, or other connector elements 304. Light is emitted from the light source 302 and reflects directly and indirectly off of the various surfaces of the reflector 300, so as to be projected out of the opening 108. In the depicted embodiment, light reflects primarily off the reflector portion 300*b* and reflector lip 300'. Certain portions of the reflector 300 illuminate certain portions of the wall height based on, inter alia, their reflectivities, specularities, radii, etc. The depicted reflector 300 includes four direct reflection zones DR that receive light directly from the light source 302 and reflect that light. Additionally, the reflector 300 includes two indirect reflection zones IR that receive light from certain direct reflection zones DR and reflect that light. As depicted in FIG. 3, several of the zones DR, IR abut or overlap. The particular construction of the reflector 300, the radii of the various curvatures, and the overlapping and abutting zones produce a smooth, even light that illuminates a wall. In certain embodiments, a light fixture utilizing the depicted reflector 300 may illuminate a wall at a ratio of about 10:1 from ceiling to floor. That is, lumens directed at the top portion of the wall will be ten times the intensity of the lumens directed at the lower portion of the wall. Existing wall wash fixtures more commonly attain ratios of 20:1 or greater. Other embodiments of the light fixtures described herein may illuminate a wall at about 5:1 to about 8:1.

The direct reflection zones $DR_1$, $DR_2$, $DR_3$, and $DR_4$ illuminate the wall heights $H_1$, $H_2$, $H_3$, and $H_4$, respectively. As depicted in the figures below, direct reflection zones $DR_1$ and $DR_2$ directly illuminate wall heights $H_1$ and $H_2$. Light reflected from direct reflection zones $DR_3$ and $DR_4$ first reflects off indirect reflection zones $IR_1$ and $IR_2$, respectively, before illuminating wall heights $H_3$ and $H_4$, respectively. The diffusion, reflectivity, and specularity of the various reflection zones also impacts the light directed to the wall heights. For example, the reflector body 300 generally is manufactured of a material displaying high diffusion, high reflectivity, and low specularity. In certain embodiments, the reflector body may be finished with a finish such as polyester T GIC powder coating available, for example, from Cardinal Paint as T001-WH434. Such finish has a specularity (brightness, gloss) of about 10.

A material displaying high diffusion, high reflectivity, and high specularity is used for direct reflection zones $DR_1$, $DR_4$, and a portion of $DR_3$. In the depicted embodiment, these zones are defined by a perforated plate 304, and may be the 2000GP, MIRO 20 product available from Alanod GmBH & Co. This material has a specularity (brightness, gloss) of about 20-90. The plate 304 is configured to extend the full length of the reflector body 300. The plate 304 itself has a lower specularity than the reflector 300 material. The perforations enable the plate 304 to reflect some of the light from the light source 302 more brightly (i.e., the light that passes through the perforations to reach the reflector 300 material) and less brightly (i.e., the light that is reflected by the plate 304). This plate 304 also has a radius $R_A$ that defines direct reflection zones $DR_1$, $DR_4$, and a portion of $DR_3$. Reflector radius $R_B$ defines direct reflection zones $DR_2$ and a portion of $DR_3$. Reflector radius $R_C$ allows for the reflection of light from direct reflection zone $DR_3$ to pass unimpeded to indirect reflection zone $IR_1$. Reflector radius $R_D$ defines indirect reflection zones $IR_2$ and a substantial portion of $IR_1$. Various reflector radii may be utilized, as required or desired for a particular application. For example $R_A$ may be about 1.125 inches to about 1.375 inches. $R_B$ may be about 1.5 inches to about 2.0 inches. $R_C$ may be about 0.125 inches to about 0.375 inches. In certain embodiments, $R_C$ may utilize a sharp (i.e, non-curved) transition. $R_D$ may be about 2.8 inches to about 3.3 inches. Other radii are contemplated.

$R_A$, in an example embodiment, is about 1.25 inches. Reflector radius $R_B$ is a radius of about 1.8 inches. Reflector radius $R_C$ is about 0.25 inches, while reflector radius $R_D$ is about 3.05 inches. Notably, radii $R_A$-$R_C$ are generally concave, relative to the light source 302, while radius $R_D$ is generally convex. The generally convex radius $R_D$ enables the reflector lip 300' to direct light very close to the ceiling, to illuminate the highest portions of the wall.

Figure 4A:
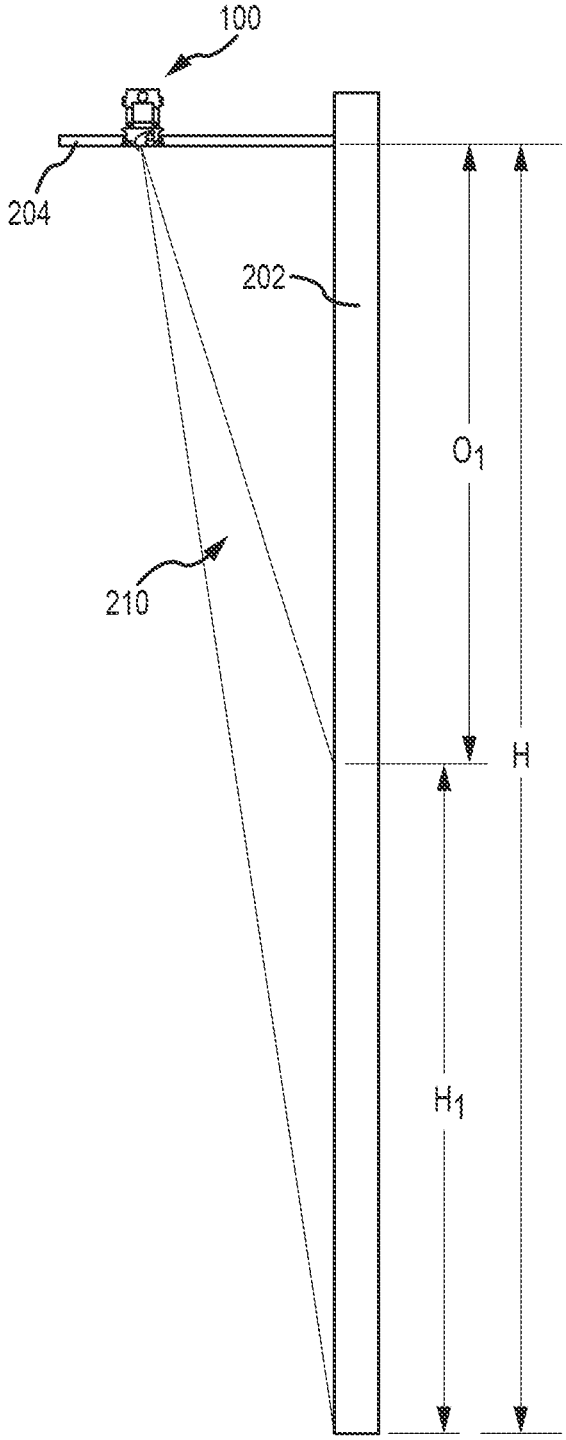
FIG. 4A depicts a beam pattern for lighting a first wall height in accordance with the embodiment of FIG. 2.
Figure 4B:
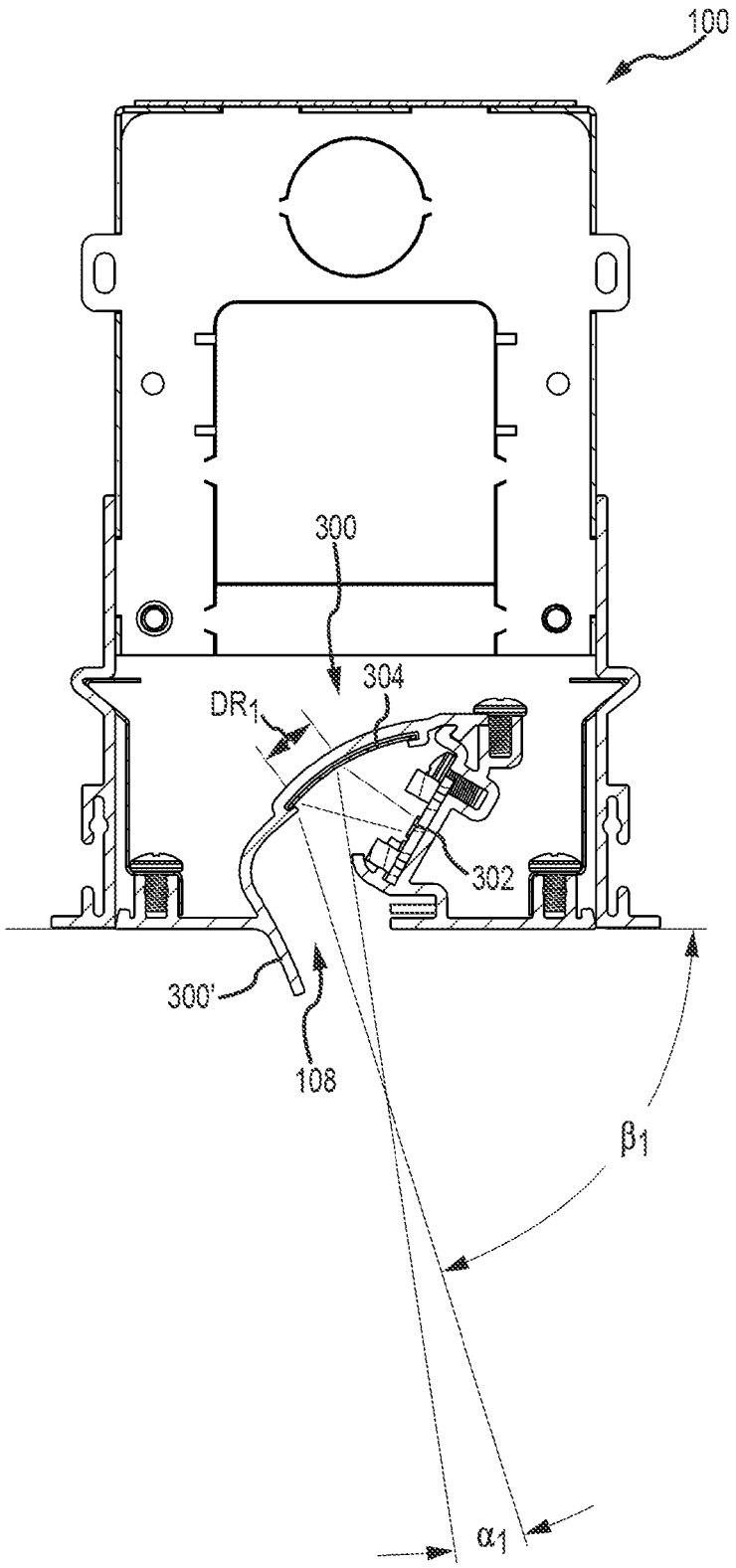
FIG. 4B depicts an enlarged side sectional view of a wall wash light fixture and the beam pattern for lighting the first wall height in accordance with FIG. 4A.

FIG. 4A depicts the beam pattern 210 for lighting the first wall height or portion $H_1$, and FIG. 4B depicts an enlarged side sectional view of the wall wash light fixture 100 and the beam pattern 210 for lighting the first wall height $H_1$. FIGS. 4A and 4B are described together. The light fixture 100 includes the reflector 300 and the light source 302. The light source 302 emits light directly at direct reflection zone $DR_1$, which is defined by a portion of the perforated plate 304, and thus has a lower specularity than the other parts of the reflector 300. Light is reflected off of direct reflection zone $DR_1$ and passes out of the opening 108. The pattern angle $\alpha_1$ of beam portion 210 is offset from the ceiling 204 by offset angle $\beta_1$, so as to light wall portion $H_1$. Wall portion $H_1$ is offset from the ceiling 204 by an offset distance $O_1$. In one example embodiment, a light fixture is installed at a distance d of about 18 inches from a wall having a height H of 12 feet. In such an embodiment, pattern angle $\alpha_1$ is about 9° and offset angle $\beta_1$ is about 73°, so as to illuminate a first wall zone $H_1$ of about 62 inches, as measured from the floor. Thus, the offset distance $O_1$ is about 58 inches. This embodiment completes a reflector having the reflector construction and radii as described above, that is: $R_A$ is about 1.25 inches, $R_B$ is about 1.8 inches, $R_C$ is about 0.25 inches, and $R_D$ is about 3.05 inches.

Figure 5A:
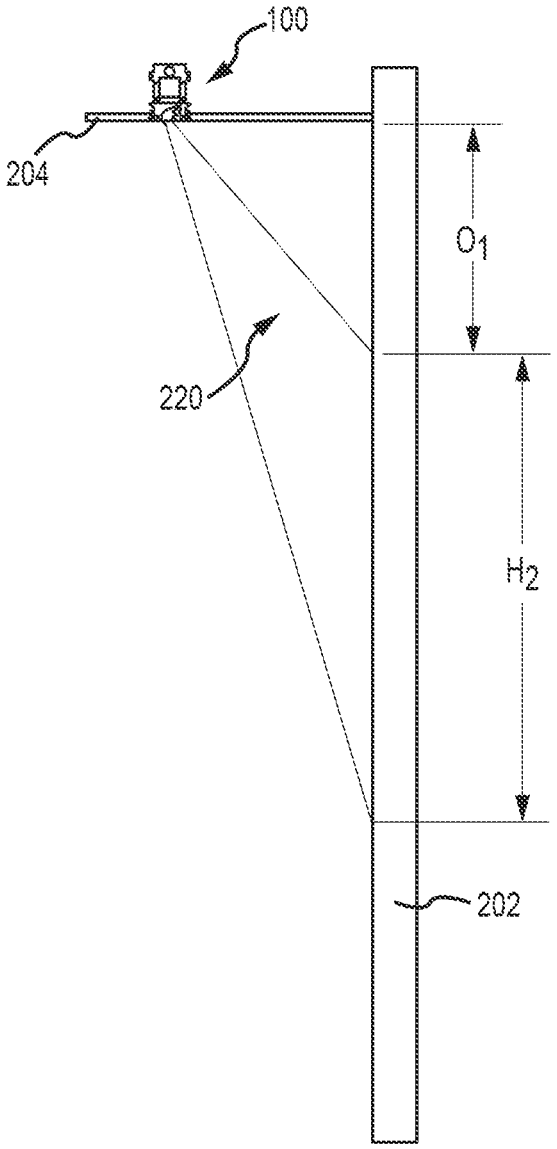
FIG. 5A depicts a beam pattern for lighting a second wall height in accordance with the embodiment of FIG. 2.
Figure 5B:
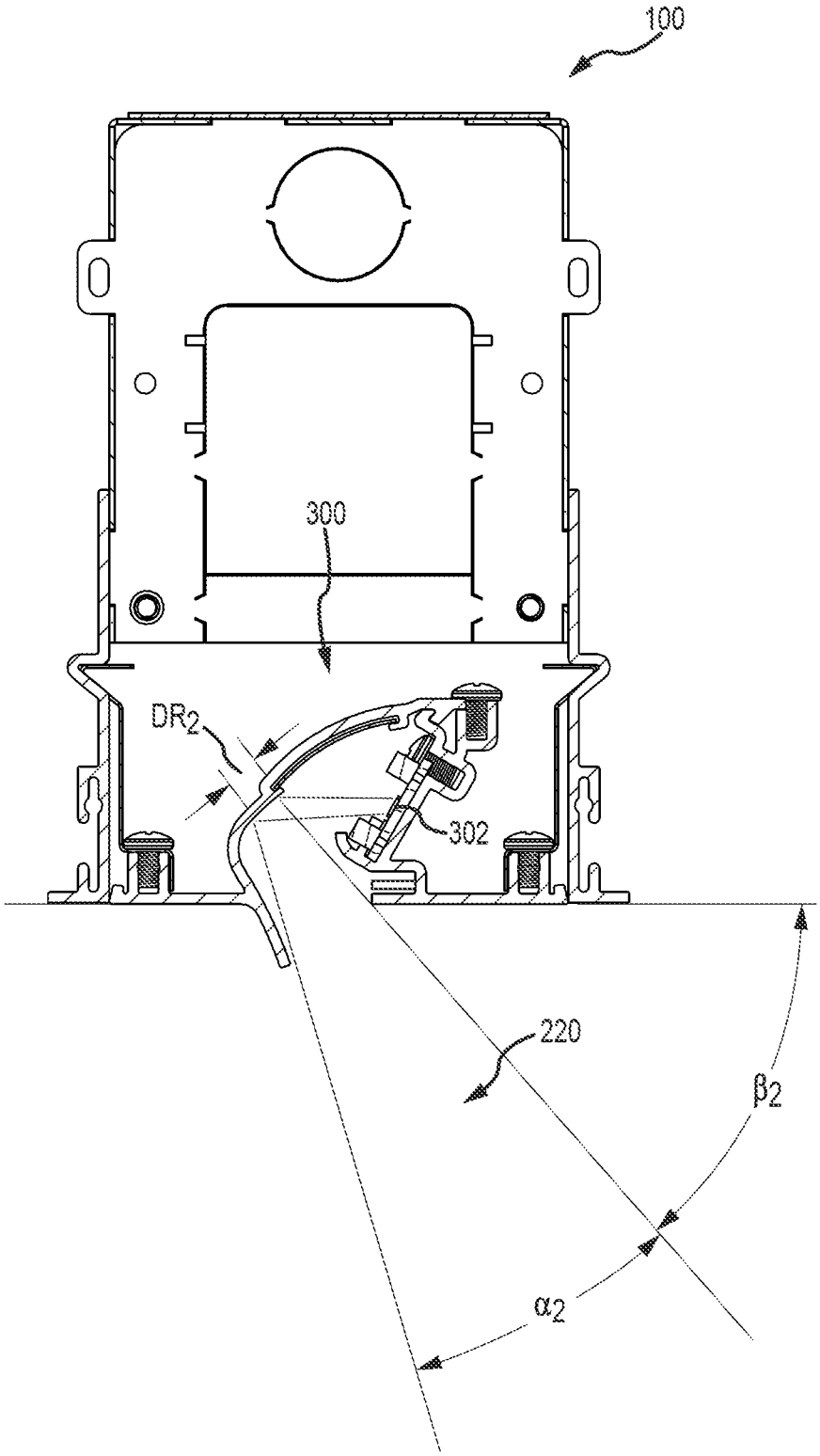
FIG. 5B depicts an enlarged side sectional view of a wall wash light fixture and the beam pattern for lighting the second wall height in accordance with FIG. 5A.

FIG. 5A depicts the beam pattern 220 for lighting the second wall portion $H_2$, and FIG. 5B depicts an enlarged side sectional view of the wall wash light fixture 100 and the beam pattern 220 for lighting the second wall portion $H_2$. FIGS. 5A and 5B are described together. The light fixture 100 includes the reflector 300 and the light source 302. The light source 302 emits light directly at direct reflection zone $DR_2$, which is defined by a portion of the reflector 300 having a low relative specularity. Light is reflected off of direct reflection zone $DR_2$ and passes out of the opening 108. The pattern angle $\alpha_2$ of beam portion 220 is offset from the ceiling 204 by offset angle $\beta_2$, so as to light wall portion $H_2$. Wall portion $H_2$ is offset from the ceiling 204 by an offset distance $O_2$. In the example embodiment provided above with regard to FIGS. 4A and 4B, where the light fixture is installed at a distance d of about 18 inches from a wall having a height H of 12 feet, pattern angle $\alpha_2$ is about 25° and offset angle $\beta_2$ is about 48°. Such a pattern illuminates a second wall portion $H_2$ of about 42 inches. The offset distance $O_2$ is about 20 inches.

Figure 6A:
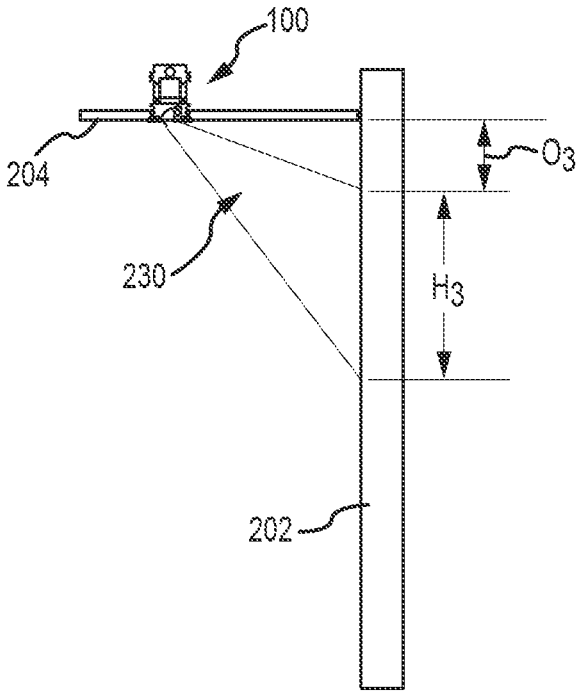
FIG. 6A depicts a beam pattern for lighting a third wall height in accordance with the embodiment of FIG. 2.
Figure 6B:
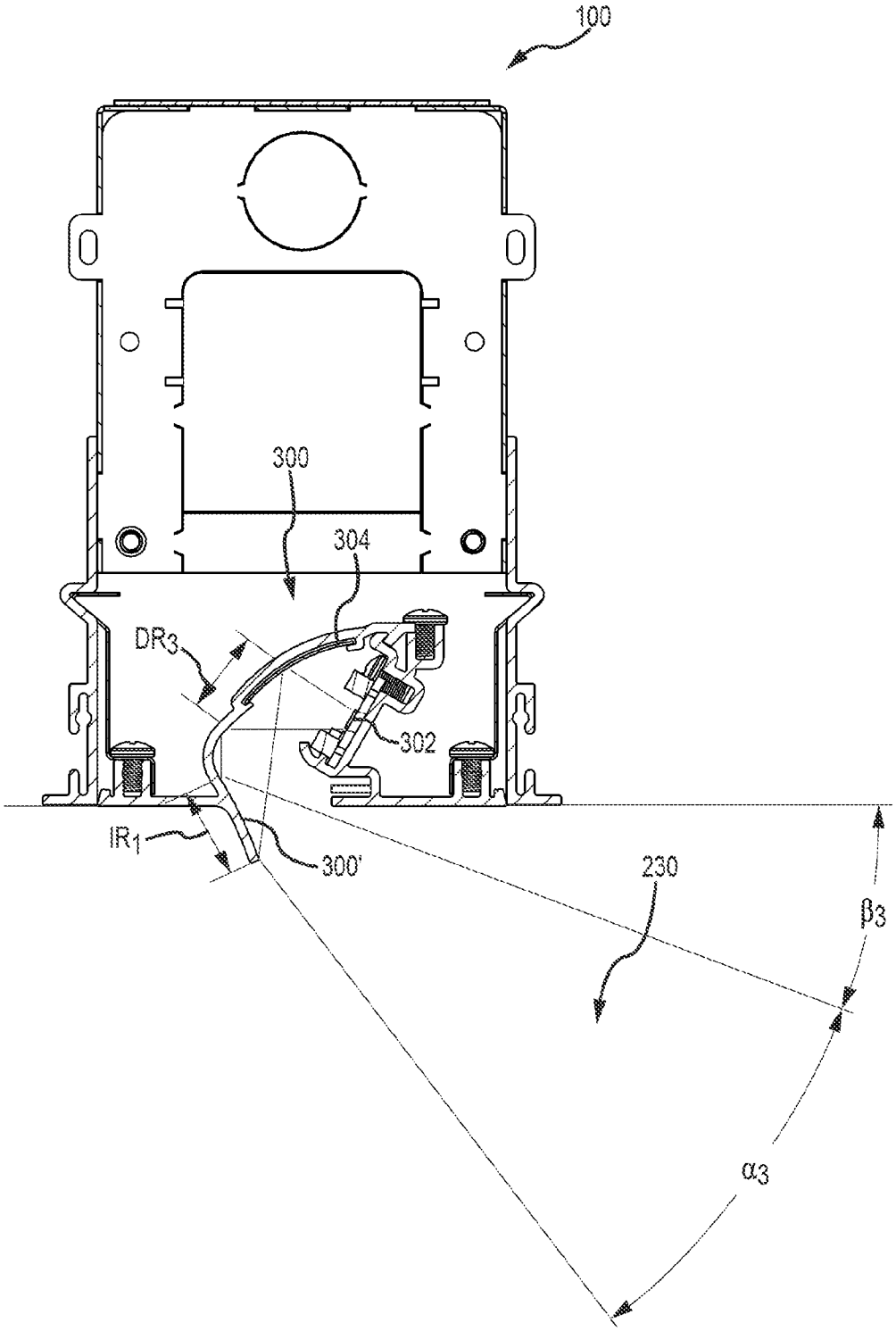
FIG. 6B depicts an enlarged side sectional view of a wall wash light fixture and the beam pattern for lighting the third wall height in accordance with FIG. 6A.

FIG. 6A depicts the beam pattern 230 for lighting the third wall portion $H_3$, and FIG. 6B depicts an enlarged side sectional view of the wall wash light fixture 100 and the beam pattern 230 for lighting the third wall portion $H_3$. FIGS. 6A and 6B are described together. The light fixture 100 includes the reflector 300 and the light source 302. The light source 302 emits light directly at direct reflection zone $DR_3$. Direct reflection zone $DR_3$ overlaps both direct reflection zones $DR_1$ and $DR_2$, and thus is defined by both a portion of the reflector 300 having a lower relative specularity, and a portion of the perforated plate 304 having a higher relative specularity. Light is reflected off of direct reflection zone $DR_3$ and is then reflected off indirect reflection zone $IR_1$, before passing out of the opening 108. The pattern angle $\alpha_3$ of beam portion 230 is offset from the ceiling 204 by offset angle $\beta_3$, so as to light wall portion $H_3$. Wall portion $H_3$ is offset from the ceiling 204 by an offset distance $O_3$. In the example embodiment provided above with regards to FIGS. 4A and 4B, where the light fixture is installed at a distance d of about 18 inches from a wall having a height H of 12 feet, pattern angle $\alpha_3$ is about 32° and offset angle $\beta_3$ is about 20°. Such a pattern illuminates a third wall portion $H_3$ of about 17 inches. The offset distance $O_3$ is about 7 inches.

Figure 7A:
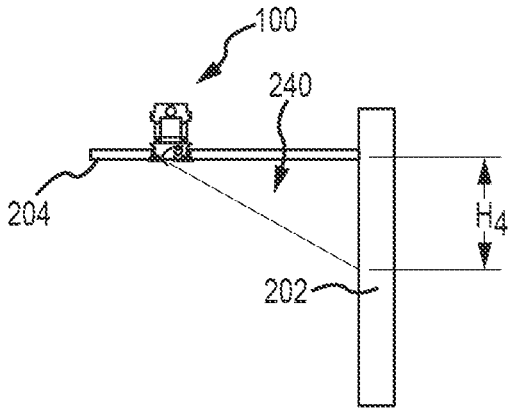
FIG. 7A depicts a beam pattern for lighting a fourth wall height in accordance with the embodiment of FIG. 2.
Figure 7B:
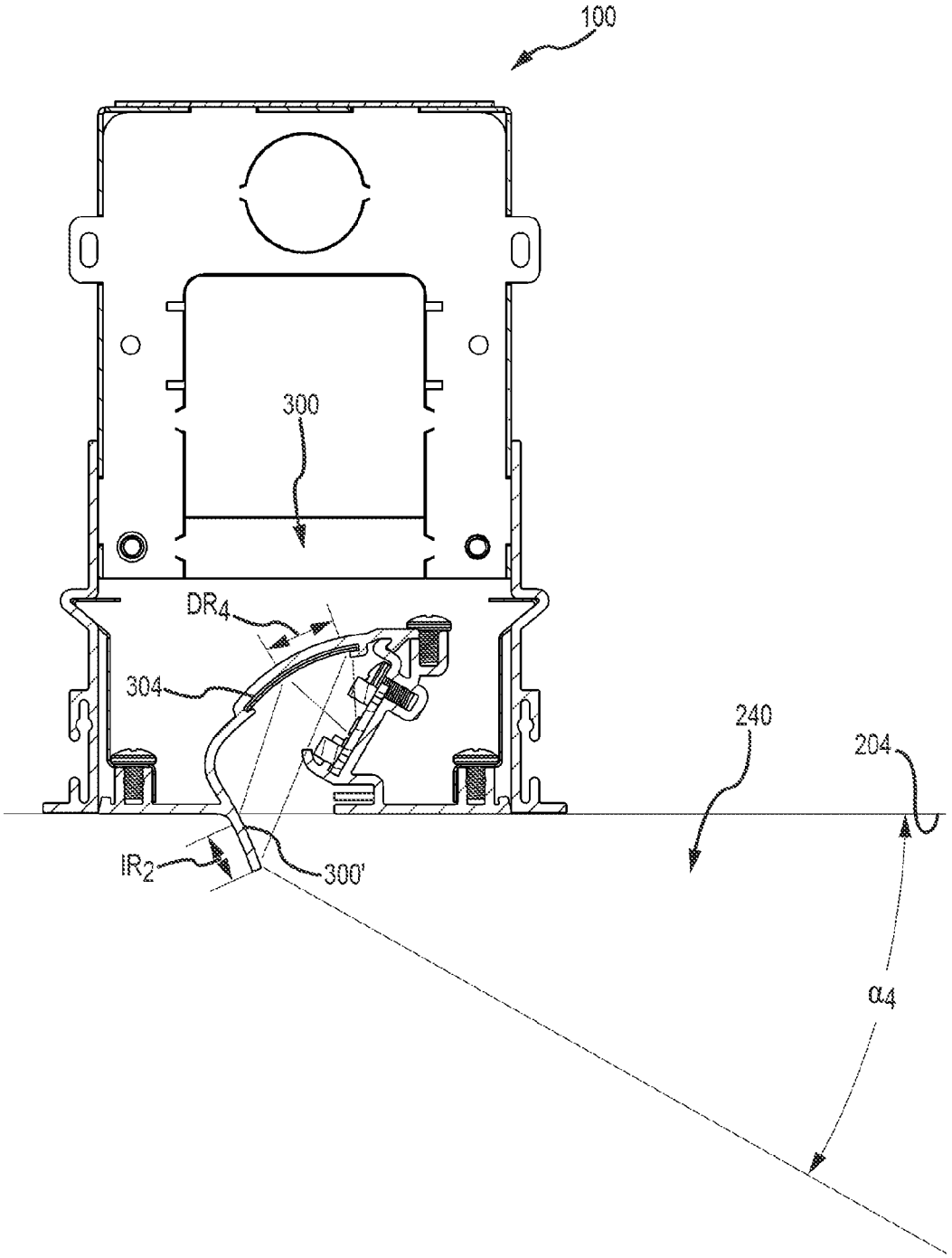
FIG. 7B depicts an enlarged side sectional view of a wall wash light fixture and the beam pattern for lighting the fourth wall height in accordance with FIG. 7A.

FIG. 7A depicts the beam pattern 240 for lighting the fourth wall portion $H_4$, and FIG. 7B depicts an enlarged side sectional view of the wall wash light fixture 100 and the beam pattern 240 for lighting the fourth wall portion $H_4$. FIGS. 7A and 7B are described together. The light fixture 100 includes the reflector 300 and the light source 302. The light source 302 emits light directly at direct reflection zone $DR_4$. Direct reflection zone $DR_4$ is defined by a portion of the perforated plate 304, and thus has a higher specularity than the other parts of the reflector 300. Light is reflected off of direct reflection zone $DR_4$ and is then reflected off indirect reflection zone $IR_2$, before passing out of the opening 108. The pattern angle $\alpha_4$ of beam portion 240 is bounded at one edge by the ceiling 204, so as to light wall portion $H_4$. Wall portion $H_4$ is bounded at one end by the ceiling 204. In the example embodiment provided above with regard to FIGS. 4A and 4B, were the light fixture is installed at a distance d of about 18 inches from a wall having a height H of 12 feet, pattern angle $\alpha_4$ is about 29°. Such a pattern illuminates a fourth wall zone $H_4$ of about 11 inches down from the ceiling 204.

Figure 8A:
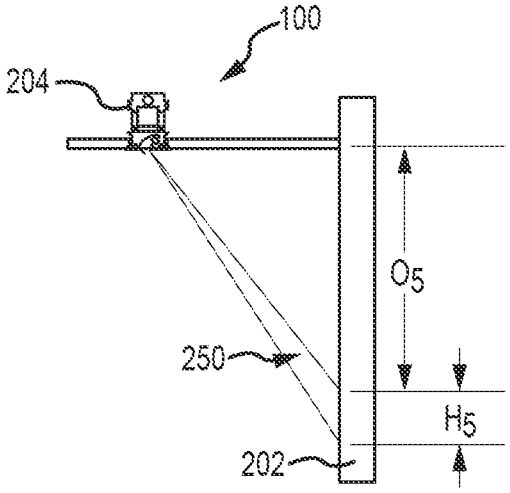
FIG. 8A depicts a beam pattern for lighting a fifth wall height in accordance with the embodiment of FIG. 2.
Figure 8B:
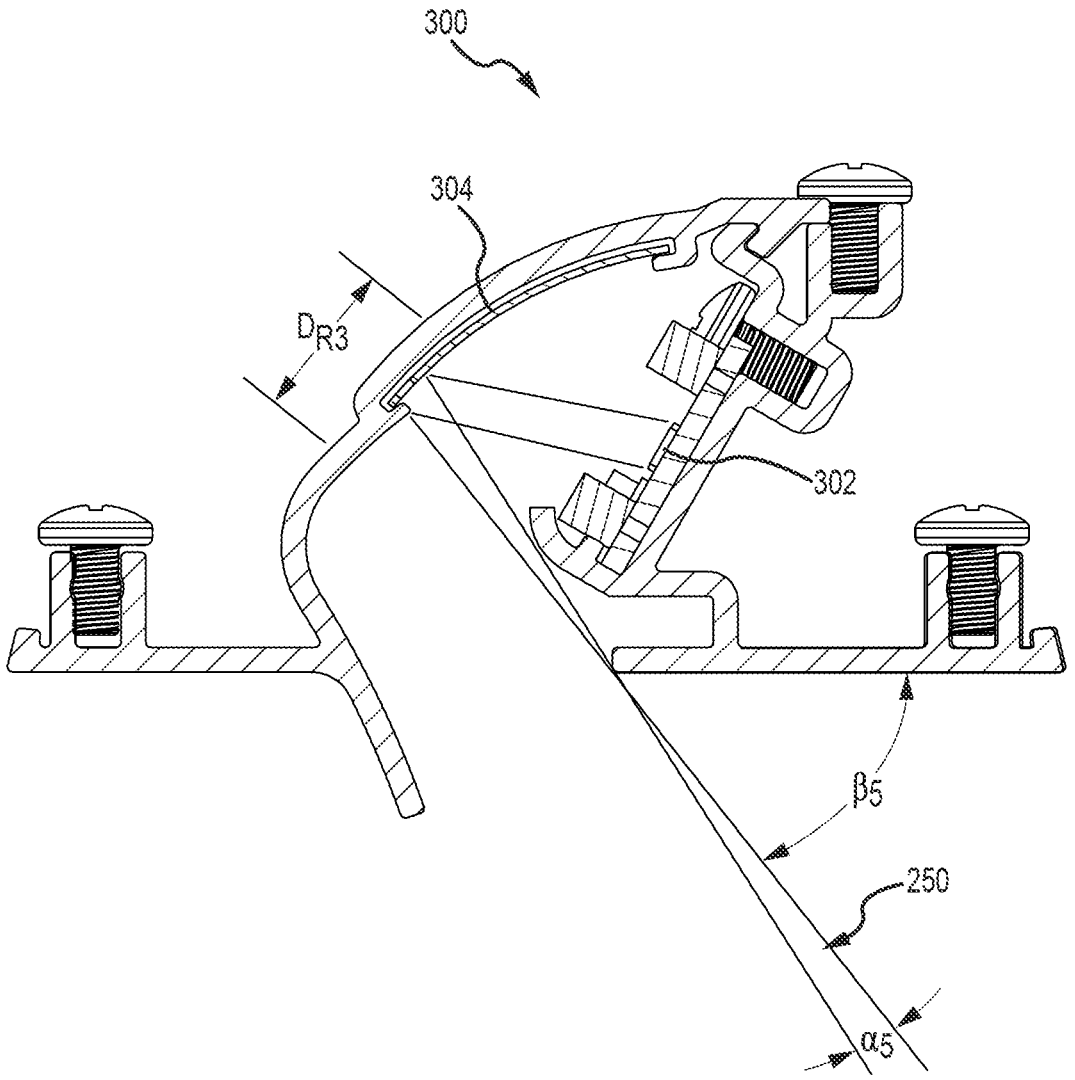
FIG. 8B depicts an enlarged side sectional view of a wall wash light fixture and the beam pattern for lighting the fifth wall height in accordance with FIG. 8A.

FIG. 8A depicts the beam pattern 250 for lighting a portion of the wall at a transition wall portion $H_5$ between the second wall portion $H_2$ and the third wall portion $H_3$, and FIG. 8B depicts an enlarged side sectional view of the wall wash light fixture 100 and the beam pattern 250 for lighting the transition wall portion $H_5$. FIGS. 8A and 8B are described together. It has been discovered that a fall off of illumination levels is present between the second wall portion $H_2$ and the third wall portion $H_3$, which forms a striation (i.e., a noticeable darker portion) on the wall 202. By positioning the perforated plate 304 as depicted, illumination along the wall 202 maintains a smoother transition and the striation is reduced or eliminated. The light fixture 100 includes the reflector 300 and the light source 302. The light source 302 emits light directly at a portion of direct reflection zone $DR_3$ defined by the perforated plate 304. This portion of the perforated plate is proximate zone $DR_2$, and is referred to as direct reflection zone $DR_5$, even though it forms a part of direct reflection zone $DR_3$. The pattern angle $\alpha_5$ of beam portion 250 is offset from the ceiling 204 by offset angle $\beta_5$, so as to light wall portion $H_5$. Wall portion $H_5$ is offset from the ceiling 204 by an offset distance $O_5$. In the example embodiment provided above with regards to FIGS. 4A and 4B, where the light fixture is installed at a distance d of about 18 inches from a wall having a height H of 12 feet, pattern angle $\alpha_5$ is about 6° and offset angle $\beta_5$ is about 52°. Such a pattern illuminates the transition wall portion $H_5$ of about 5 inches. The offset distance $O_5$ is about 23 inches.

The example embodiment described above with regard to FIGS. 4A and 4B (and FIGS. 5A-8B) is but one embodiment contemplated to illuminate a wall having a particular height H of up to 12 feet and an installation distance d of about 18 inches. Certain structural aspects of the reflector contained within a light fixture consistent with the present disclosure may be modified to illuminate taller or shorter walls at greater or lesser installation distances. Referring back to FIGS. 2 and 3, reflector radii $R_A$ and $R_B$ help direct light received from the light source 302 a considerable distance away from the light fixture. These radii $R_A$ and $R_B$ may be adjusted to direct the light even further. The convexity of the lip 300', as well as its radius $R_D$, enables the light fixture 100 to light portions of the wall proximate the ceiling. This is notable since the light source 302 is directed up and away from the wall 202.

In FIG. 2, the wall portions $H_1$-$H_4$ are depicted. As can be seen, certain of the beam pattern portions overlap, for example, beam portion 210 overlaps beam portion 220, beam portion 220 overlaps beam portion 230, and beam portion 230 overlaps beam portion 240. The various angles and distances described in FIGS. 4A-7B also illustrate this overlap. FIGS. 8A-8B depict a specific configuration of the light fixture 100 utilized to correct for a striation in light output. The overlapping portions of beam portions present an even distribution of light along the illuminated wall. Additionally, it has been discovered that even distribution of light along the illuminated wall may be obtained by ensuring the four wall portions are particular fractions of the total height of the wall. In one example, it has been found particularly desirable that first wall zone $H_1$ is about one-half of wall height H, second wall zone $H_2$ is about one-third of wall height H, third wall zone $H_3$ is about one-seventh of wall height H, and fourth wall zone $H_4$ is about one-tenth of wall height H.

Figure 9B:
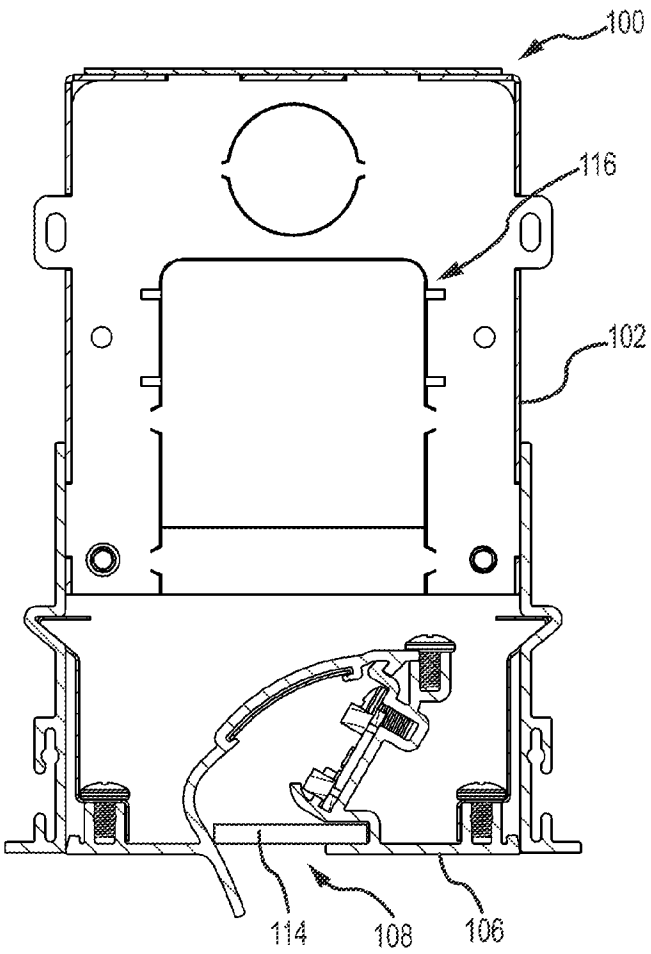
FIGS. 9A and 9B depict side sectional views of wall wash light fixtures in accordance with other embodiments of the technology.
Figure 9A:
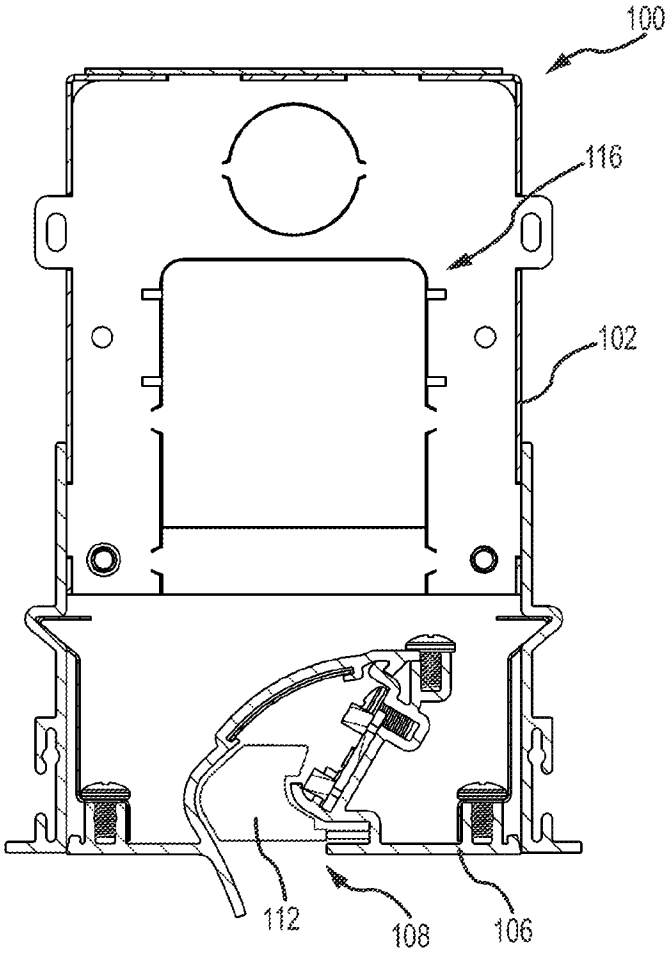

FIGS. 9A and 9B depict side sectional views of wall wash light fixtures 100 in accordance with other embodiments of the technology. As with the embodiments above, the light fixture 100 includes a housing 102 and a bottom plate 106 at least partially defining an opening 108. Both embodiments also utilize an element that spans the opening 108. For example, the fixture 100 of FIG. 9A includes a baffle 112 that spans the opening 108. The baffle 112 includes a plurality of parallel plates. Since the plates of the baffle 112 are parallel to the light emitted from the opening, the baffle 112 does not interfere with light emission. The baffle 112 adds a distinctive visual element to the light fixture, but also helps limit the line of sight into the interior 116 of the housing 102. With the baffle 112 installed, the line of sight into the interior is obstructed unless a person is standing directly below the installed fixture 100 and looking straight upward. This helps minimize glare and reduces brightness. The fixture 100 of FIG. 9B includes a translucent lens 114, which may be clear or colored. Use of the lens 114 may change the color of the emitted light and also prevents dust or other debris from entering the interior 116 of the housing 102.

Figure 10:
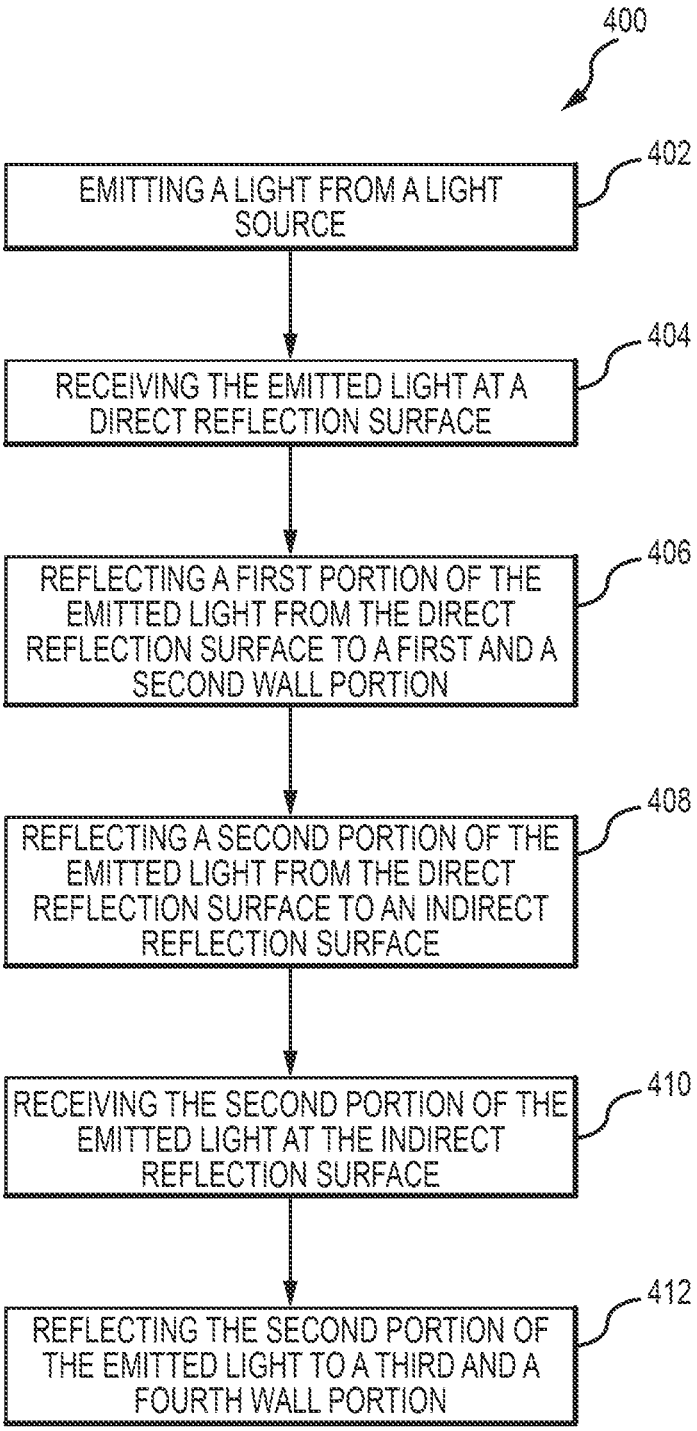
FIG. 10 depicts a method of lighting a wall with a wall wash light fixture.

FIG. 10 depicts a method 400 of lighting a wall with a wall wash light fixture. The light fixture is disposed in a ceiling proximate a wall. The wall has several portions or heights. A first wall portion or height is located proximate a bottom edge of the wall. A second wall portion is disposed above the first wall portion. A third wall portion is disposed above the second wall portion. Finally, a fourth wall portion is disposed above the third wall portion and proximate the ceiling. In operation 402, light is emitted from a light source disposed within the light fixture. The light source is disposed so as to direct the emitted light away from the wall to be illuminated. The emitted light is received at a direct reflection surface in operation 404. This direct reflection surface reflects the emitted light in two portions. A first portion of the emitted light is reflected to first and second portions of the wall in operation 406. The light reflected towards the first and second portions of the wall is reflected by two discrete zones of a reflector. A first zone of the reflector reflects light to the first portion of the wall, while a second zone of the reflector reflects light to the second portion of the wall. In certain embodiments, the specularity of the first zone is greater than a specularity of the second zone. A second portion of the emitted light is reflected to an indirect reflection surface in operation 408. This second portion of the emitted light is received by the indirect reflection surface in operation 410. In operation 412, this second portion of the emitted light is reflected from the indirect reflection surface to third and fourth portions of the wall. The light reflected towards the third and fourth portions of the wall is reflected by two discrete zones of the reflector. A third zone of the reflector reflects light to the third portion of the wall, while a fourth zone of the reflector reflects light to the fourth portion of the wall.

The light fixtures described herein may be formed of materials typical for manufacture of light fixtures. For example, the housing may be manufactured of formed cold rolled steel of 12, 18, 20, or 24 gauge thickness. The reflector and perforated plate may be formed of extruded aluminum. Exposed surfaces, such as the bottom plate, may also be of extruded aluminum and may be powder-coated, painted, or otherwise finished to match any environment. Corrosion or moisture resistant coatings may be used if the environment demands.

Although the light fixture described herein is explained in the context of a wall wash application, the fixture may be used to provide asymmetrical illumination to virtually any surface, regardless of size or orientation. For example, the light need not be used only on full height walls, but may also light walls that do not extend completely from a floor to a ceiling. Soffits that extend down from a ceiling may also be illuminated with the fixture. Wall art, whiteboards, or other features may also be illuminated. Additionally, the fixture may be installed in a wall to illuminate a floor or ceiling.

Unless otherwise indicated, all numbers expressing dimensions, speed, weight, and so forth used in the specification and claims are to be understood as being modified in all instances by the term "about." Accordingly, unless indicated to the contrary, the numerical parameters set forth in the specification and attached claims are approximations that may vary depending upon the desired properties sought to be obtained by the present technology.

As used herein, "about" refers to a degree of deviation based on experimental error typical for the particular property identified. The latitude provided the term "about" will depend on the specific context and particular property and can be readily discerned by those skilled in the art. The term "about" is not intended to either expand or limit the degree of equivalents that may otherwise be afforded a particular value. Further, unless otherwise stated, the term "about" shall expressly include "exactly," consistent with the discussions regarding ranges and numerical data. Lengths, sizes, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 5 to about 10" should be interpreted to include not only the explicitly recited values of about 5 to about 10, but also include individual values and sub-ranges within the indicated range. Thus, included in this numerical range are individual values such as 6, 7.5, 9, 10, etc., as well as sub-ranges such as from 5.5-9.5, 8-9.5, 6-9, etc. This same principle applies to ranges reciting only one numerical value. Furthermore, such an interpretation should apply regardless of the breadth of the range or the characteristics being described.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements.

While there have been described herein what are to be considered exemplary and preferred embodiments of the present technology, other modifications of the technology will become apparent to those skilled in the art from the teachings herein. The particular methods of manufacture and geometries disclosed herein are exemplary in nature and are not to be considered limiting. It is therefore desired to be secured all such modifications as fall within the spirit and scope of the technology. Accordingly, what is desired to be secured by Letters Patent is the technology as defined and differentiated herein, and all equivalents.

What is claimed is:

1. A light fixture comprising:

a housing comprising a bottom plate at least partially defining an opening;

a light source disposed within the housing; and a reflector disposed such that light emitted from the light source is received by the reflector and reflected, wherein the reflector comprises:

a direct reflection surface disposed within the housing for receiving light emitted from the light source and reflecting (a) a first portion of light directly out of the opening and (b) a second portion of light; and an indirect reflection surface for receiving the second portion of light from the direct reflection surface and reflecting the second portion of light, wherein the at least a portion of the indirect reflection surface is disposed on a portion of the bottom plate located exterior to the housing.

2. The light fixture of claim 1, wherein the direct reflection surface comprises four direct reflection zones, wherein a first direct reflection zone and a second direct reflection zone reflect the first portion of light.

3. The light fixture of claim 2, wherein a third direct reflection zone and a fourth direct reflection zone reflect the second portion of light.

4. The light fixture of claim 3, wherein the indirect reflection surface comprises:

a first indirect reflection zone for receiving light from the third direct reflection zone; and a second indirect reflection zone for receiving light from the fourth direct reflection zone.

5. The light fixture of claim 3, wherein the third direct reflection zone at least partially overlaps the first direct reflection zone and the second direct reflection zone.

6. The light fixture of claim 4, wherein the first indirect reflection zone at least partially overlaps the second indirect reflection zone.

7. The light fixture of claim 1, wherein the direct reflection surface comprises a plurality of surfaces.

8. The light fixture of claim 3, wherein the first direct reflection zone and the fourth direct reflection zone are associated with a high relative specularity surface, and the second direct reflection zone is associated with a low relative specularity surface.

9. The light fixture of claim 4, wherein substantially all of the second indirect reflection zone is disposed on the portion of the indirect reflection surface disposed on the portion of the bottom plate located exterior to the housing.

10. The light fixture of claim 1, further comprising at least one of a translucent lens and a baffle proximate the opening.

11. A method of lighting, with a light fixture disposed in a ceiling, a wall having a first wall portion located proximate a bottom edge of the wall, a second wall portion disposed above the first wall portion, a third wall portion disposed above the second wall portion, and a fourth wall portion disposed above the third wall portion and proximate the ceiling, the method comprising:

emitting light from a light source disposed within the light fixture, wherein the light is emitted in a direction away from the wall;

receiving the emitted light at a direct reflection surface;

reflecting at least a first portion of the emitted light from the direct reflection surface to the first wall portion and the second wall portion;

reflecting at least a second portion of the emitted light from the direct reflection surface to an indirect reflection surface;

receiving the second portion of emitted light at the indirect reflection surface; and reflecting the second portion of emitted light from the indirect reflection surface to the third wall portion and the fourth wall portion.

12. The method of claim 11, wherein the direct reflection surface comprises a first direct reflection zone for reflecting the light to the first wall zone and a second direct reflection zone for reflecting the light to the second wall zone.

13. The method of claim 12, wherein the first direct reflection zone comprises a specularity greater than a specularity of the second direct reflection zone.

14. A light fixture comprising:

a housing defining an interior;

a bottom plate secured to the housing, the bottom plate at least partially defining an opening;

a light source disposed within the interior;

a direct reflection surface disposed in the interior opposite the light source, wherein the direct reflection surface is adapted to reflect light emitted by the light source; and an indirect reflection surface disposed on a portion of the bottom plate extending out from the interior of the housing and proximate the opening, wherein the indirect reflection surface is adapted to reflect at least a portion of the light reflected by the direct reflection surface.

15. The light fixture of claim 14, wherein the direct reflection surface comprises a high relative specularity surface and a low relative specularity surface.

16. The light fixture of claim 15, wherein the indirect reflection surface comprises a low relative specularity surface.

17. The light fixture of claim 14, wherein the direct reflection surface is substantially concave and wherein the indirect reflection surface is substantially convex.

18. The light fixture of claim 15, wherein the high relative specularity surface comprises a perforated element.

19. The light fixture of claim 15, further comprising at least one of a translucent lens and a baffle proximate the opening.

20. The light fixture of claim 14, wherein at least a portion of the indirect reflection surface is disposed both in the interior and on an exterior of the housing.

* * * * *